US010551782B2

(12) United States Patent
Maeda et al.

(10) Patent No.: US 10,551,782 B2
(45) Date of Patent: Feb. 4, 2020

(54) IMAGE FORMING APPARATUS FOR PERFORMING SUPPLY CONTROL OF DEVELOPER

(71) Applicant: CANON KABUSHIKI KAISHA, Tokyo (JP)

(72) Inventors: Yuichiro Maeda, Kashiwa (JP); Kazuhiro Akiba, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/114,634

(22) Filed: Aug. 28, 2018

(65) Prior Publication Data

US 2019/0072890 A1 Mar. 7, 2019

(30) Foreign Application Priority Data

Sep. 7, 2017 (JP) ..... 2017-172426

(51) Int. Cl.
*G03G 15/00* (2006.01)

(52) U.S. Cl.
CPC ..... *G03G 15/556* (2013.01); *G03G 15/5033* (2013.01); *G03G 2215/0888* (2013.01)

(58) Field of Classification Search
CPC ..... G03G 15/0877; G03G 15/5025; G03G 15/5033; G03G 15/556; G03G 2215/0888
See application file for complete search history.

(56) References Cited

U.S. PATENT DOCUMENTS

| | | | | |
|---|---|---|---|---|
| 5,652,947 | A | 7/1997 | Izumizaki | |
| 2011/0304887 | A1 | 12/2011 | Nakase | |
| 2016/0070198 | A1* | 3/2016 | Morinaga | G03G 15/553 399/27 |
| 2016/0147173 | A1* | 5/2016 | Yoneima | G03G 13/09 399/53 |
| 2017/0285534 | A1* | 10/2017 | Kawano | G03G 15/1605 |
| 2017/0343920 | A1* | 11/2017 | Miyadera | H04N 1/40068 |

FOREIGN PATENT DOCUMENTS

| | | | |
|---|---|---|---|
| JP | 11-004314 | A | 1/1999 |
| JP | 2010-072178 | A | 4/2010 |

* cited by examiner

*Primary Examiner* — Francis C Gray
(74) *Attorney, Agent, or Firm* — Venable LLP

(57) ABSTRACT

An image forming apparatus includes a first controller having an image processor that performs image processing on image data, the first controller configured to determine a first statistic value based on the image data, and output the first statistic value; an obtaining unit configured to obtain the image data; an image forming unit configured to form, based on the image data, an image by using toner; a supply unit configured to supply toner to the image forming unit; and a second controller configured to control the supply unit based on the first statistic value. In a case where the first statistic value is not outputted by the first controller in a predetermined period, the second controller controls the supply unit based on a second statistic value, the second statistic value being determined based on the image data.

7 Claims, 15 Drawing Sheets

IMAGE FORMING APPARATUS FOR PERFORMING SUPPLY CONTROL OF DEVELOPER

BACKGROUND OF THE INVENTION

Field of the Invention

The present invention relates to a technique for controlling the supply of toner in an image forming apparatus.

Description of the Related Art

Japanese Patent Laid-Open No. 11-004314 discloses an image forming apparatus including a video controller that performs image processing on input image data, and an engine controller that forms an image on a sheet using an electrophotographic process based on the image data which is subjected to image processing. The engine controller forms an image on a sheet based on information regarding a print job that is notified from the video controller and information from a sensor provided in the image forming apparatus. As a result of separating the video controller from a mechanical configuration of a main body of the image forming apparatus, the video controller can be used in common among a plurality of apparatuses, and therefore cost can be reduced.

U.S. Pat. No. 5,652,947 discloses a configuration in which a video controller counts a pixel count value and notifies an engine controller of the counted pixel count value. The pixel count value is an integrated value of pixel values (tone) of respective pixels in an image to be formed. The engine controller determines a consumption amount of developer based on the notified pixel count value, and supplies the developer to a developing unit in an image forming apparatus.

The tone characteristic of an image forming apparatus, that is, a relationship between tones indicated by image data and tones (developer densities) of an image that is actually formed, is not an ideal characteristic indicated by the broken line in FIG. 17A, and has a characteristic as indicated by the solid line. Therefore, there is a difference between the pixel count value and the actual consumption amount of developer. In U.S. Pat. No. 5,652,947, the pixel count value is corrected such that the pixel count value approximates the actual consumption amount of developer.

In the case where the image forming apparatus has a tone characteristic indicated by the solid line in FIG. 17A, if printing is performed based on raw image data, the density of an image to be formed differs from the density indicated by the image data. Therefore, US-2011-0304887 discloses a configuration in which tone correction is performed on image data such that the tone of an image to be formed matches the tone indicated by the image data. Specifically, in the case where the tone characteristic of an image forming apparatus is as indicated by the dotted line in FIG. 17B, a γ lookup table (γLUT) whose data represents a characteristic, as indicated by the one dot chain line in FIG. 17B, opposite to the tone characteristic of the image forming apparatus is generated in advance. Then, as a result of correcting the image data based on the γLUT, the tone of an image to be formed by the image forming apparatus is made to match the tone indicated by the original image data, as shown by the solid line in FIG. 17B. In the case where the tone correction is performed, the pixel count value of image data matches the actual consumption amount of developer even if correction on a pixel count value, as described in U.S. Pat. No. 5,652,947, is not performed.

Incidentally, in recent years, supply control of developer performed by an engine controller is required to be implemented at timings such that the supply control is performed in a more real time manner. This is caused by an increase in the amount of developer to be consumed per unit time caused by an increase in speed of printing performed by an image forming apparatus. This is also caused by a decrease in the amount of developer that can be stored in a developing unit caused by downsizing (smaller capacity) the developing unit in order to decrease the size and cost of an image forming apparatus. In general, if the amount of developer in a developing unit is small, there may be a shortage of the developer in the developing unit when a high density image is printed. Also, if the amount of developer in a developing unit is large, the developer loses fluidity and aggregates inside the developing unit, and as a result, a reduction in the image quality and clogging inside the developing unit are likely to occur. That is, the amount of developer inside the developing unit needs to be kept in a suitable range by performing supply control of the developer at an appropriate timing.

Note that, with respect to the timing at which the supply control of developer is implemented, a method in which the control is performed every time a developer image is formed on one sheet, or when the number of printed sheets reaches a predetermined number, is generally adopted, but a method in which the control is performed when a pixel count value reaches a predetermined value may be adopted. Also, in Japanese Patent Laid-Open No. 2010-72178, a method is disclosed in which a developer image to be formed on one sheet is divided in a main scanning direction and in a sub scanning direction, and the supply control of developer is performed by grasping the usage amount of the developer at smaller intervals.

Image forming apparatuses in recent years have become multifunctionalized, and image data is input from an external computer, a FAX machine, and the like in various ways, other than the image data input from a document scanner (document image reading apparatus). Also, image data is input at an arbitrary timing by a plurality of users or from a print server or the like. Therefore, the video controller needs to perform many types of processes in parallel at a timing that is not predictable. In the case where many types of processes are performed in parallel, a delay occurs in the processing in the video controller, and therefore a delay in notifying the engine controller of the pixel count value from the video controller may occur.

Although adopting a high-performance CPU is conceivable as a method of avoiding such a situation, this method incurs an increase in the cost of the image forming apparatus. Also, as a result of, after finishing transmission of a pixel count value from the video controller to the engine controller, printing the corresponding image data, toner can be reliably supplied, but the throughput of the image forming apparatus decreases in this case.

Furthermore, a method is conceivable in which, as a result of the engine controller performing the pixel count, the notification of the pixel count value from the video controller to the engine controller is made unnecessary. However, in an image forming apparatus in which tone correction is performed on image data, the pixel count is performed based on the image data subjected to tone correction, and therefore the pixel count value does not reflect the actual consumption amount of developer.

Also, in a configuration in which the engine controller performs a pixel count, and the engine controller also performs tone correction, a processing block of the video controller that is common between products is provided in the engine controller. In this case, the processing to be performed by the video controller that can be used in common between a plurality of models is reduced, and as a result, the effect of the decrease in cost is impaired.

SUMMARY OF THE INVENTION

According to an aspect of the present invention, an image forming apparatus includes: a first controller having an image processor that performs image processing to image data, the first controller configured to determine a first statistic value based on the image data, and output the first statistic value; an obtaining unit configured to obtain the image data from the image processor; an image forming unit configured to form, based on the image data obtained by the obtaining unit, an image by using toner; a supply unit configured to supply toner to the image forming unit; and a second controller configured to control the supply unit based on the first statistic value output from the first controller. In a case where the first statistic value is not outputted by the first controller in a predetermined period, the second controller controls the supply unit based on a second statistic value, the second statistic value being determined based on the image data obtained by the obtaining unit.

Further features of the present invention will become apparent from the following description of exemplary embodiments with reference to the attached drawings.

DESCRIPTION OF THE EMBODIMENTS

Hereinafter, illustrative embodiments of the present invention will be described with reference to the drawings. Note that the following embodiments are illustrative and do not limit the present invention to the contents of the embodiments. Also, in the following diagrams, constituent elements that are not required for describing the embodiments are omitted.

Figure 1:
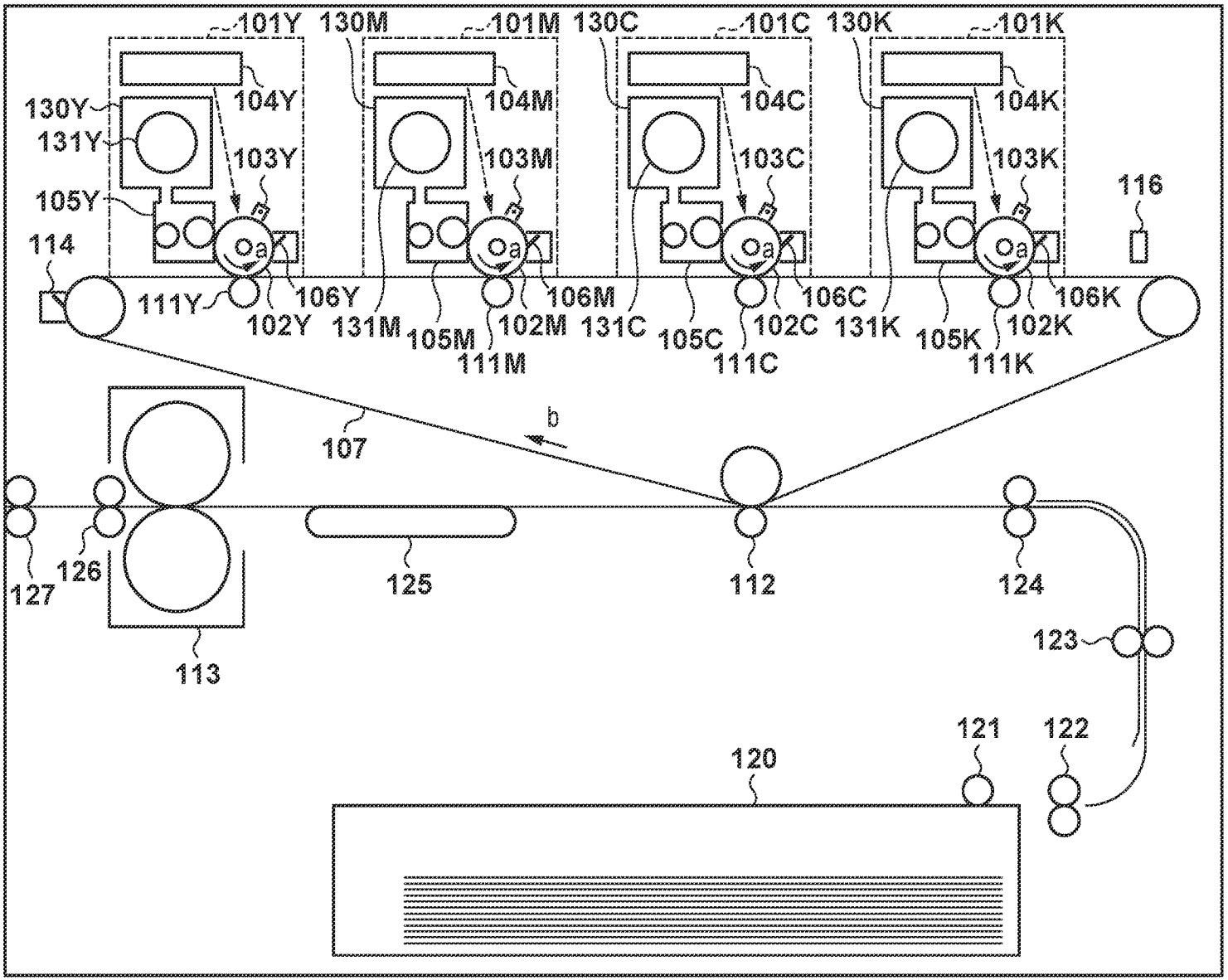
FIG. 1 is a configuration diagram of an image forming apparatus.

FIG. 1 is a configuration diagram of an image forming apparatus according to a present embodiment. The image forming apparatus includes four image forming units 101Y, 101M, 101C, and 101K that respectively form yellow, magenta, cyan, and black images. Note that Y, M, C, and K at the end of reference signs, in the diagrams, respectively indicate that the colors of developer images of which members denoted by these reference numerals are related to the forming of an image are yellow, magenta, cyan, and black. However, reference signs without Y, M, C, and K at the end will be used in cases where the colors do not need to be distinguished. A photosensitive member 102 in an image forming unit 101 is rotationally driven in the direction of the arrow a when an image is formed. A charging device 103 charges the surface of the photosensitive member 102, which is rotationally driven, at a uniform potential. An optical scanning device 104 exposes the charged surface of the photosensitive member 102, and forms an electrostatic latent image on the photosensitive member 102. A developing unit 105 develops the electrostatic latent image on the photosensitive member 102 by using developer so as to form a developer image on the photosensitive member 102. A supply device 130 includes a container unit 131 that contains developer, and supplies the developer in the container unit 131 to the developing unit 105.

A primary transfer device 111 outputs a primary transfer bias, and transfers the developer image on the photosensitive member 102 to an intermediate transfer belt 107 that is rotationally driven in the direction of the arrow b in the diagram. Note that a full-color toner image can be formed on the intermediate transfer belt 107 by transferring toner images of respective photosensitive members 102 to the intermediate transfer belt 107 so as to be overlaid thereon. The cleaning unit 106 collects developer that has not been transferred from the photosensitive member 102 to the intermediate transfer belt 107 and is still on the photosensitive member 102. The developer image formed on the intermediate transfer belt 107 is conveyed to a position opposing the secondary transfer device 112 by rotation of the intermediate transfer belt 107. Meanwhile, a sheet stored in a feed cassette 120 is conveyed to the position opposing the secondary transfer device 112 by rollers 121, 122, 123, and 124. The secondary transfer device 112 outputs a secondary transfer bias, and transfers the developer image formed on the intermediate transfer belt 107 to the sheet. The developer that remains on the intermediate transfer belt 107 without being transferred to the sheet is collected by a cleaning unit 114.

The sheet onto which the developer image is transferred is conveyed to a fixing device 113 by a conveyance belt 125. The fixing device 113 heats and presses the sheet so as to fix the developer image to the sheet. After the developer image has been fixed, the sheet is discharged to the outside of the image forming apparatus by rollers 126 and 127. Also, a density sensor 116 for detecting a test pattern, which includes a developer image of a plurality of tones, that is formed on the intermediate transfer belt 107 is provided at a position opposing the intermediate transfer belt 107. A γLUT to be used in the tone correction is created and updated based on the detection result of the test pattern by the density sensor 116.

Figure 2:
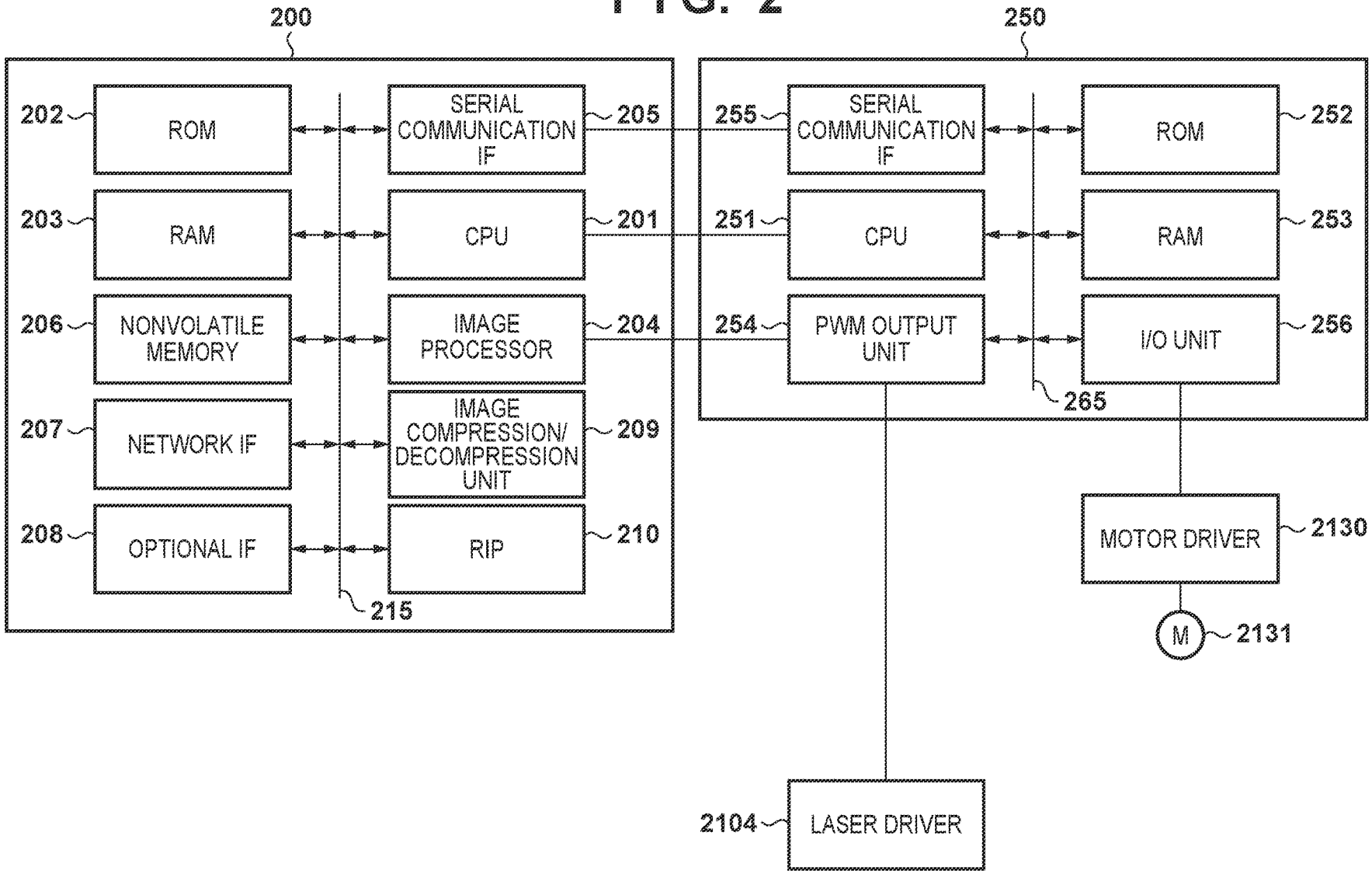
FIG. 2 is a diagram illustrating a control configuration of the image forming apparatus.

FIG. 2 is a diagram illustrating a control configuration of the image forming apparatus 100. A CPU 201 of a video controller 200 controls units of the video controller 200. A ROM 202 stores a startup program of the CPU 201. A nonvolatile memory 206 stores a control program to be executed by the CPU 201, input image data, and the like. A RAM 203 is used for temporarily storing data or the like for the CPU 201. A network IF 207 transmits and receives image data to and from an external computer (unshown), and an optional IF 208 transmits and receives image data to and from an unshown document image reading apparatus and a FAX line.

Image data that has been input via the network IF 207 or the optional IF 208 is compressed by an image compression/decompression unit 209, and is thereafter stored in the nonvolatile memory 206. Note that, if the input image data is page description language (PDL) data, a raster image processor 210 converts the page description language data to raster image data, and thereafter, the raster image data is compressed by the image compression/decompression unit 209. Also the image compression/decompression unit 209 decompresses image data stored in the nonvolatile memory 206, and outputs the decompressed image data to an image processor 204. The image processor 204 performs image processing on the decompressed image data. Image data that has undergone image processing by the image processor 204 is output to a PWM output unit 254 in an engine controller 250.

A CPU 251 of the engine controller 250 controls units of the engine controller 250. A ROM 252 stores a control program to be executed by the CPU 251, and a RAM 253 is used for temporarily storing data or the like for the CPU 251. The PWM output unit 254 generates a pulse width modulation (PWM) signal based on the image data from the image processor 204, and transmits the generated PWM signal to a laser driver 2104 of the optical scanning device 104. Note that only one laser driver 2104 is illustrated in FIG. 2 in order to simplify the diagram, but the laser driver 2104 is provided for each of colors used for forming an image. The laser driver 2104 controls turning on and off of a light source of the corresponding optical scanning device 104 based on the PWM signal, which is an image signal, so as to expose the corresponding photosensitive member 102. An I/O unit 256 is connected to a motor driver 2130. The motor driver 2130 controls a motor 2131 that drives the container unit 131. Note that only one set of the motor driver 2130 and the motor 2131 is illustrated in FIG. 2 in order to simplify the diagram, but the set of the motor driver 2130 and the motor 2131 is provided for each color used to form an image. The motor driver 2130 drives the motor 2131, according to an instruction from the CPU 251, so as to rotate the container unit 131, and as a result, the developer inside the container unit 131 is supplied to the developing unit 105. Note that the amount of developer to be supplied depends on the time period during which the motor 2131 is driven, and the more the motor 2131 is rotated, the more developer is supplied to the developing unit 105.

The video controller 200 and the engine controller 250 respectively include three-wire serial communication IFs 205 and 255, and the CPU 201 and the CPU 251 transmit and receive data via these interfaces. The video controller 200 mainly notifies the engine controller 250 of information regarding a print job (hereinafter, page information) such as the size and resolution of input image data, and the type of sheet to be used (plain paper, thick paper, and the like). Also, the engine controller 250 notifies the video controller 200 of information regarding the state of the apparatus such as the image forming apparatus being in a preparation operation state or in a printable state and regarding a state of consumables, that is, whether or not a sheet is present inside the feed cassette 120, whether or not developer is present inside the container unit 131, and the like.

Figure 3:
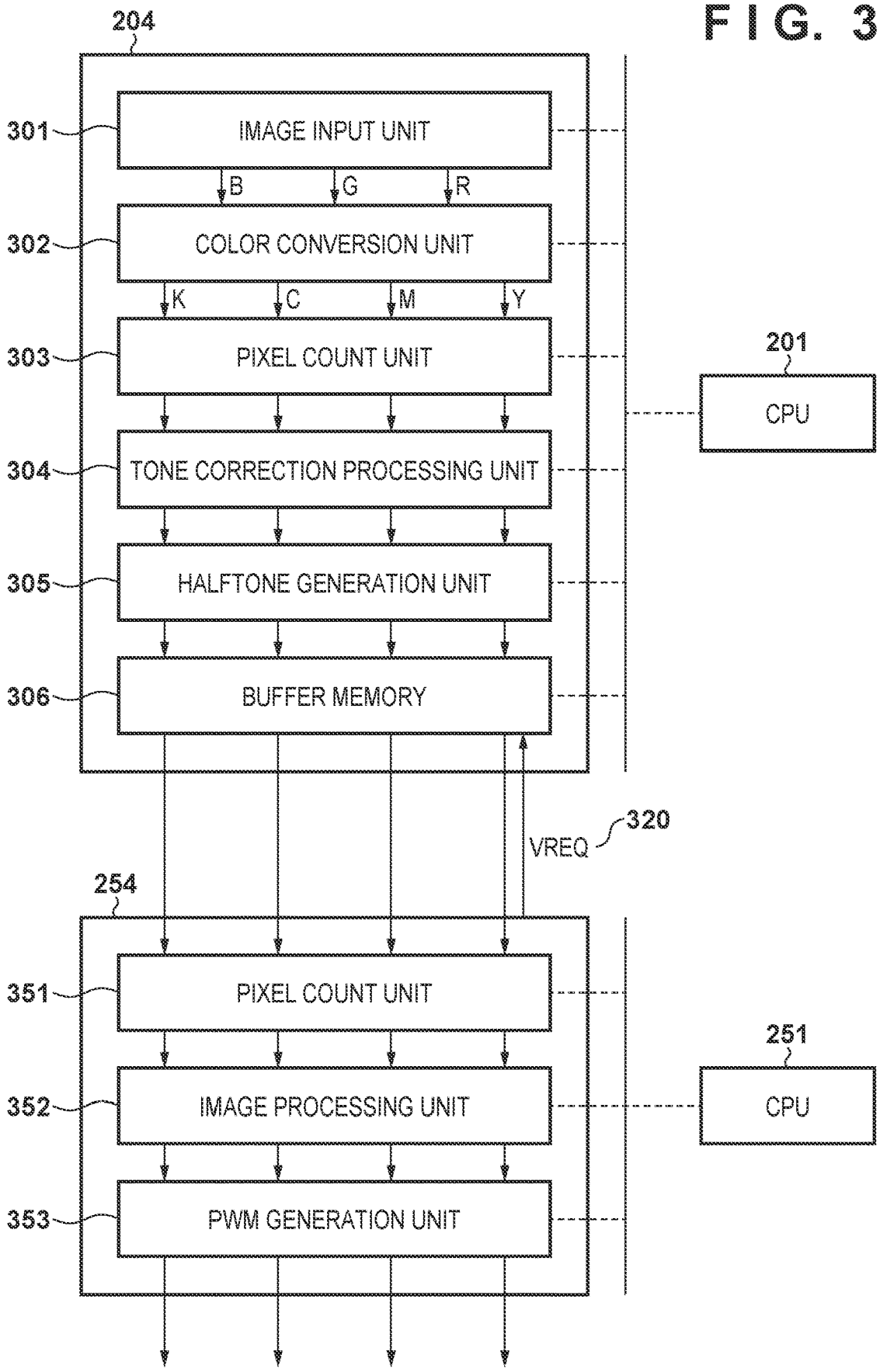
FIG. 3 is a configuration diagram of an image processor and a PWM output unit.

FIG. 3 is a configuration diagram of the image processor 204 of the video controller 200 and the PWM output unit 254 of the engine controller 250. Compressed image data stored in the nonvolatile memory 206 of the video controller 200 is decompressed by the image compression/decompression unit 209, and is thereafter input to an image input unit 301 of the image processor 204. A color conversion unit 302 converts luminance values of R (red), G (green), and B (blue) colors indicated by the image data to density values of Y (yellow), M (magenta), C (cyan), and K (black).

A pixel count unit 303 integrates, for each of Y, M, C, and K color components, a density value (pixel value) of each pixel, and stores a pixel count value indicating the integrated value to an unshown register. The pixel count unit 303 functions as a first counter. Note that, in the following description, the pixel count value generated by the pixel count unit 303 will be referred to as a first pixel count value (first statistic value). In the present embodiment, the density of each pixel is represented by 8-bit data (0 to 255). For example, if the density value of a first pixel in Y image data is 100, and the density value of a second pixel is 50, the integrated value of the first pixel and the second pixel is 150. Such integration of pixel values is performed for each color with respect to all pixels in a predetermined region. Note that, in the present embodiment, the predetermined region is a region of one sheet. For example, in the case of image data of A4 (297 mm×210 mm) size and 1200 dpi, because the region of one sheet includes 14032 pixels×9921 pixels, the pixel count unit 303 integrates density values with respect to 14032×9921=139211472 pixels. The pixel count unit 303, upon completing counting with respect to pixels in the predetermined region, outputs an interrupt signal to the CPU 201. The CPU 201 reads out the first pixel count value from the unshown register, triggered by this interrupt signal, and notifies the CPU 251 of the first pixel count value. Note that the predetermined region with respect to which pixel counting is performed may also be each region obtained by dividing the region of one sheet in the main scanning direction and the sub scanning direction.

Atone correction processing unit 304 performs tone correction processing on image data. Specifically, the tone correction processing unit 304 includes the γLUT, and corrects the image data based on this γLUT. A halftone generation unit 305 performs halftone processing on image data subjected to the tone correction processing in which the density of one pixel is expressed by an 8-bit value (0 to 255), and converts it to image data in which the density of one pixel is expressed by binary values of one bit (0, 1). Various methods are known as the halftone processing such as an error diffusion method and a dithering method, and any of these methods may be used in the present invention. A buffer memory 306 temporarily stores image data, of each color, that has undergone halftone processing. The PWM output unit 254 outputs, under the control of the CPU 251, an image request signal (VREQ) 320 to the buffer memory 306. Note that the image request signal 320 is output for each color component, and is a signal for requesting the video controller 200 to transmit image data of the corresponding color component. Upon the image request signal 320 being transmitted, the image data of the corresponding color component is output from the buffer memory 306 to the PWM output unit 254.

A pixel count unit 351 of the engine controller 250 performs, for each of Y, M, C, and K color components, a pixel count with respect to image data transmitted from the buffer memory 306 using a method similar to the method used in the pixel count unit 303 in the video controller 200. The pixel count unit 351 functions as a second counter. Note that, in the following description, the pixel count value generated by the pixel count unit 351 will be referred to as a second pixel count value (second statistic value). The pixel count unit 351 stores the second pixel count value in an unshown register, and the CPU 251 reads out the second pixel count value from this register.

Here, the first pixel count value is obtained by performing counting with respect to image data before the tone correction processing is performed, and the second pixel count value is obtained by performing counting with respect to the image data subjected to the tone correction processing. Therefore, as described above, the first pixel count value has a relatively strong correlation relationship with the amount of developer that is consumed in accordance with the formation of an image, but the second pixel count value has a relatively weak correlation relationship with the amount of developer that is consumed. An image processing unit 352 performs image processing according to the characteristic of the optical scanning device 104, such as processing for alignment in the main scanning direction and matching of magnification (registration) with respect to images of respective colors. A PWM generation unit 353 generates a PWM signal based on the image data that has undergone the processing performed by the image processing unit 352.

Figure 4:
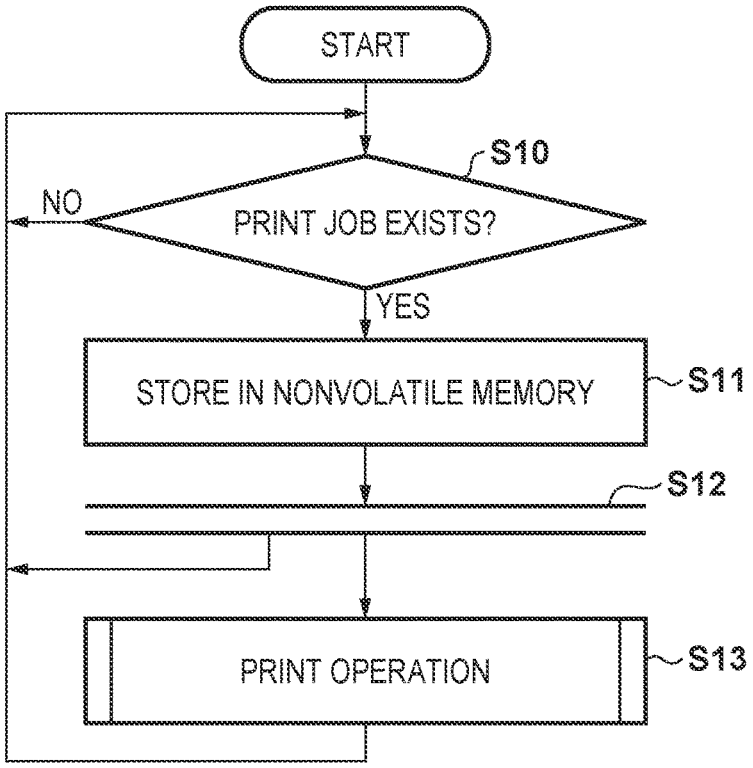
FIG. 4 is a flowchart of processing in a video controller.

FIG. 4 is a flowchart illustrating the processing performed in the video controller 200. Upon a main power supply of the image forming apparatus 100 being turned on, in step S10, the video controller 200 waits for a print job to be input from the network IF 207 or the optional IF 208. Upon the print job being input, in step S11, the image compression/decompression unit 209 compresses the input image data, and stores the data in the nonvolatile memory 206. Then, the processing of the video controller 200 is divided into two branches in step S12. That is, in one branch, a print operation is performed in step S13, and in the other branch, a further print job is waited for, in step S10. In this way, the image forming apparatus accepts the next print job even in a period in which a print operation is being performed, and as a result, user-friendliness is improved.

Figure 5:
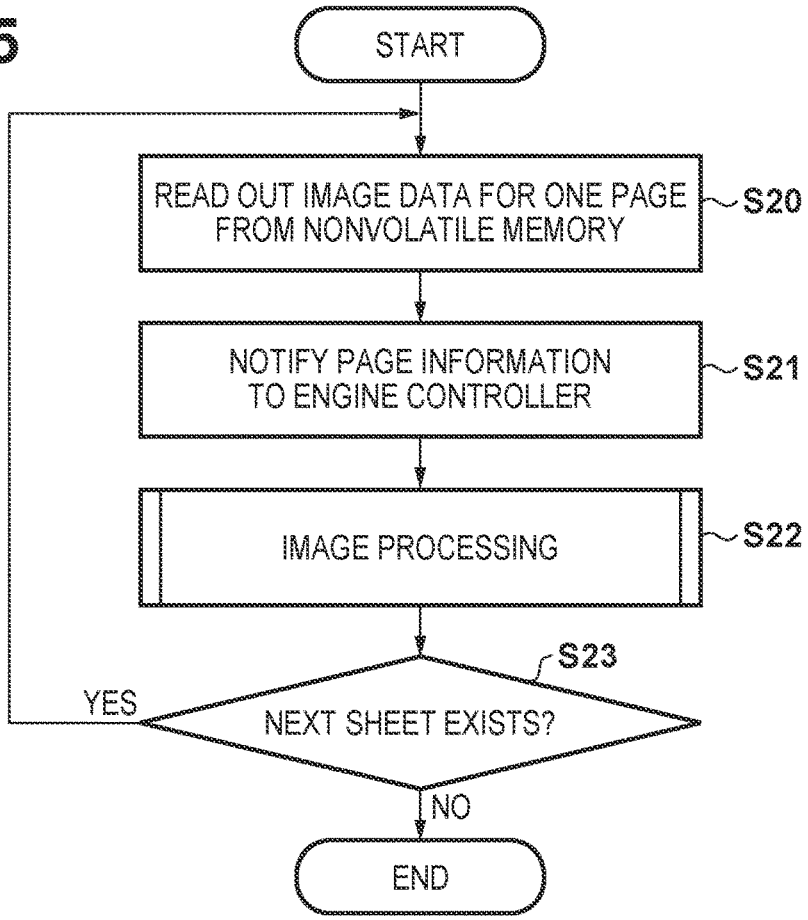
FIG. 5 is a flowchart of processing in the video controller.

FIG. 5 is a flowchart illustrating a print operation performed by the video controller 200, that is, the detailed processing in step S13 in FIG. 4. The video controller 200 decompresses image data for one page that has been read out from the nonvolatile memory 206 using the image compression/decompression unit 209, in step S20. The video controller 200 notifies the engine controller 250 of pieces of page information such as the image resolution, and the size and type of a sheet (such as plain paper or thick paper), in step S21. Next, the video controller 200 performs the series of image processing described using FIG. 3 on image data using the image processor 204. The video controller 200 determines, in step S23, whether or not there is an image to be printed on a subsequent sheet, and if there is an image to be printed on a subsequent sheet, repeats the processing from step S20 onward. On the other hand, if there is no image to be printed on a subsequent sheet, the video controller 200 ends the processing.

Figure 6:
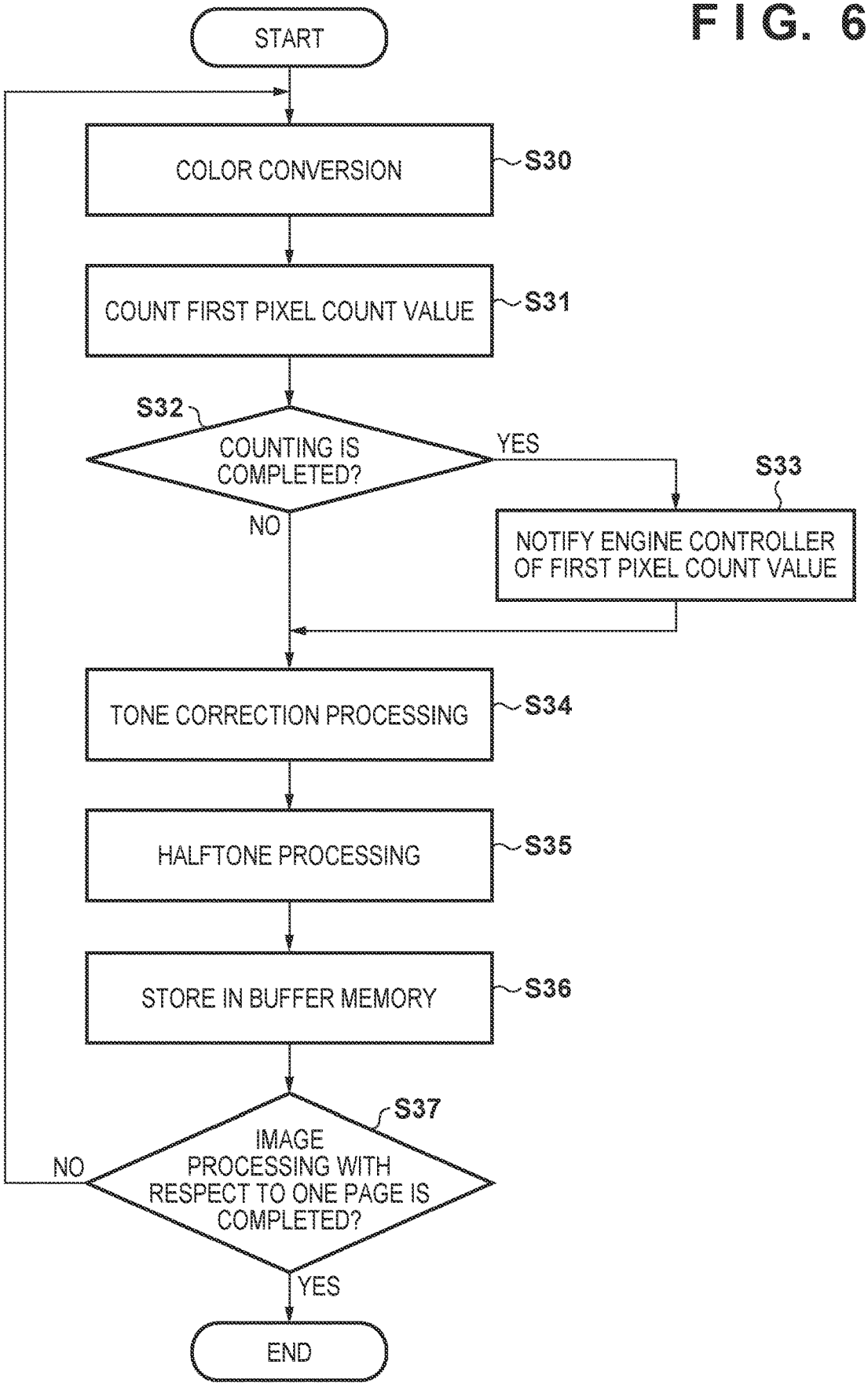
FIG. 6 is a flowchart of processing in the video controller.

FIG. 6 is a flowchart illustrating detailed processing in step S22 in FIG. 5. The video controller 200 performs color conversion with respect to each pixel in the image data, in step S30. Next, the video controller 200 counts the first pixel count value in step S31. If counting in the prescribed region is completed, in step S32, the video controller 200 reads out the first pixel count value and notifies the engine controller 250 of the first pixel count value, in step S33. On the other hand, if counting in the prescribed region is not completed, in step S32, the video controller 200 performs tone correction processing, in step S34, performs halftone processing, in step S35, and stores the image data subjected to the halftone processing in the buffer memory 306, in step S36. The video controller 200 determines whether or not image processing with respect to one page has been completed, in step S37, and if not completed, repeats the processing from step S30 onward. Note that the processing in FIG. 6 is performed with respect to each color component separately.

Figure 7:
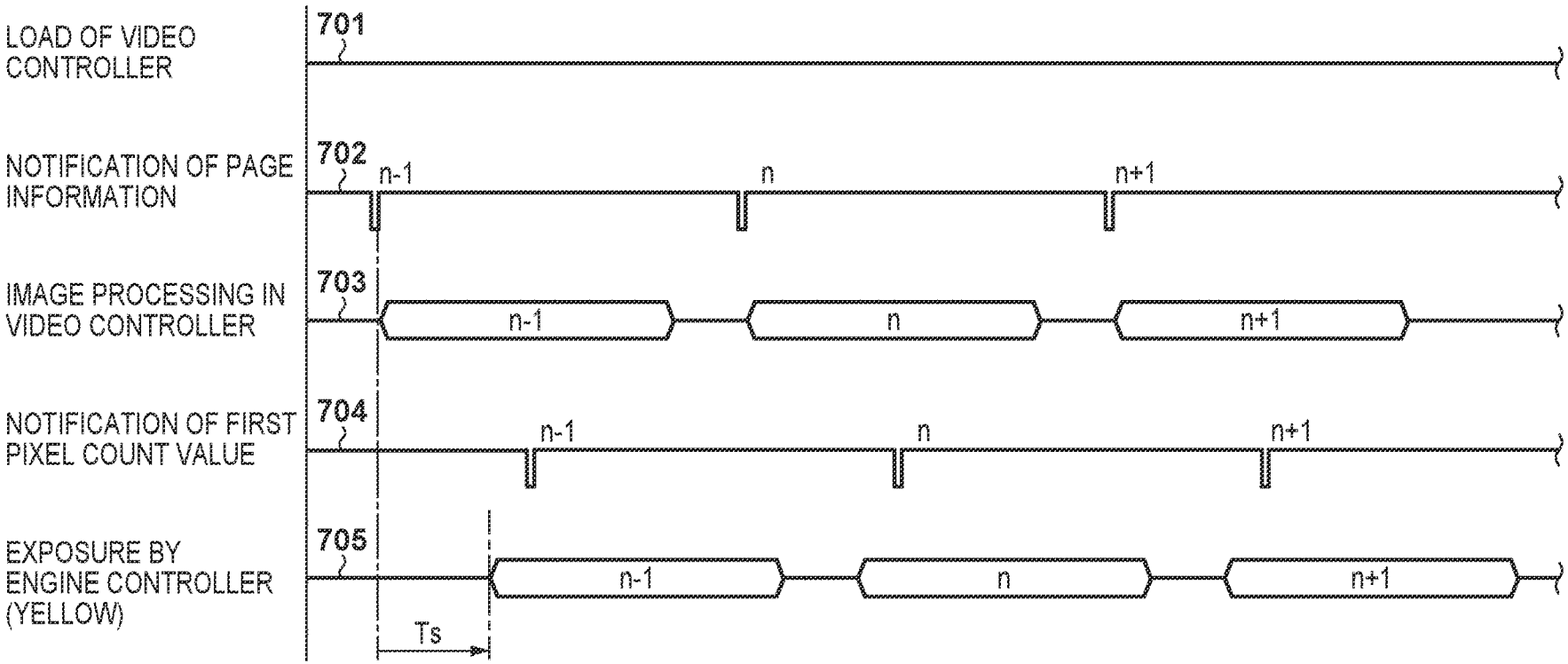
FIG. 7 is a timing chart illustrating a manner of notification of a first pixel count value.

FIG. 7 is a timing chart illustrating an example of the operations of the video controller 200 and the engine controller 250. FIG. 7 shows a manner of printing three pages of $(n-1)^{th}$ page, $n^{th}$ page, and $(n+1)^{th}$ page. The reference sign 701 indicates a load of the video controller 200, and shows that there is not a specifically large load. Also, the reference sign 702 shows a manner of notification of the page information, for each page, from the video controller 200 to the engine controller 250. Also, the reference sign 703 shows a manner of image processing performed by the image processor 204 of the video controller 200. Furthermore, the reference sign 704 shows a manner of notification of the first pixel count value from the video controller 200 to the engine controller 250. The reference sign 705 shows a manner of the engine controller 250 performing exposure of the yellow photosensitive member 102Y. The engine controller 250 starts exposure a predetermined time Ts after receiving notification of the page information. The predetermined time Ts is determined based on a time period necessary for image processing performed by the image processor 204 in the video controller 200, and a time period from when a sheet stored in the feed cassette 120 is fed out until when the sheet reaches the position opposing the secondary transfer device 112. Exposure of the magenta, cyan, and black photosensitive members 102M, 102C, and 102K is respectively started a time period td, 2×td, and 3×td after starting exposure of the yellow photosensitive member 102Y. Note that the time period td corresponds to a time period obtained by dividing the distance between the adjacent photosensitive members 102 by the moving speed of the surface of the intermediate transfer belt 107. Note that the output of the image request signal 320 from the engine controller 250 to the video controller 200 is not illustrated in order to simplify the diagram.

Figure 8:
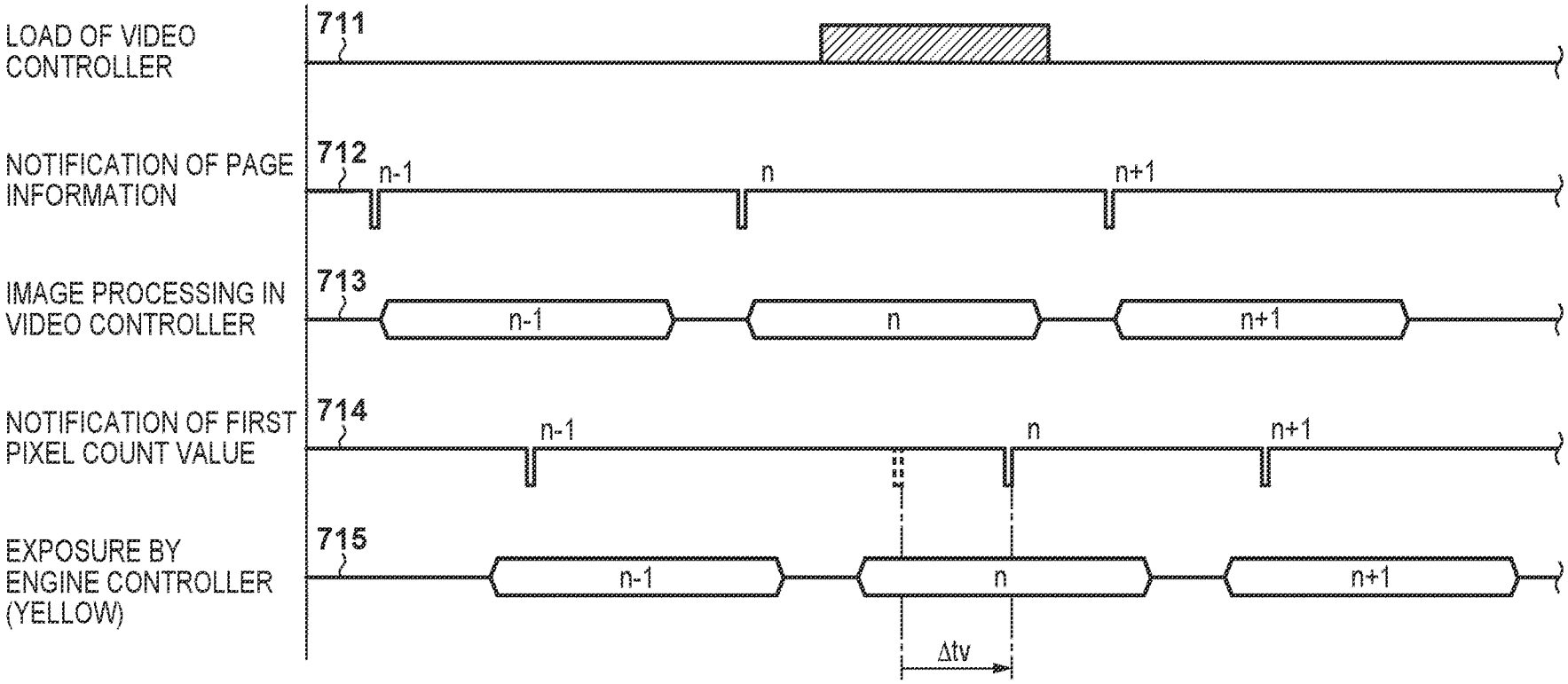
FIG. 8 is a timing chart illustrating a manner of notification of the first pixel count value.

FIG. 8 is also a timing chart illustrating an example of the operations of the video controller 200 and the engine controller 250. The reference sign 711 indicates the load of the video controller 200. In FIG. 8, the load of the video controller 200 increases in the shaded area in which other processing such as receiving further print data via the optional IF 208 is performed in parallel. In FIG. 8, the reference signs 712, 713, and 714 respectively indicate notification of page information, image processing, and notification of the first pixel count value, and the reference sign 715 indicates exposure of the photosensitive member 102Y, similarly to FIG. 7. However, in FIG. 8, the counting of the first pixel count value that is executed in a period in which the load of the video controller 200 is high is delayed, and therefore the notification of the first pixel count value regarding the page n is delayed by a time period Δtv from that shown in FIG. 7.

Figure 9:
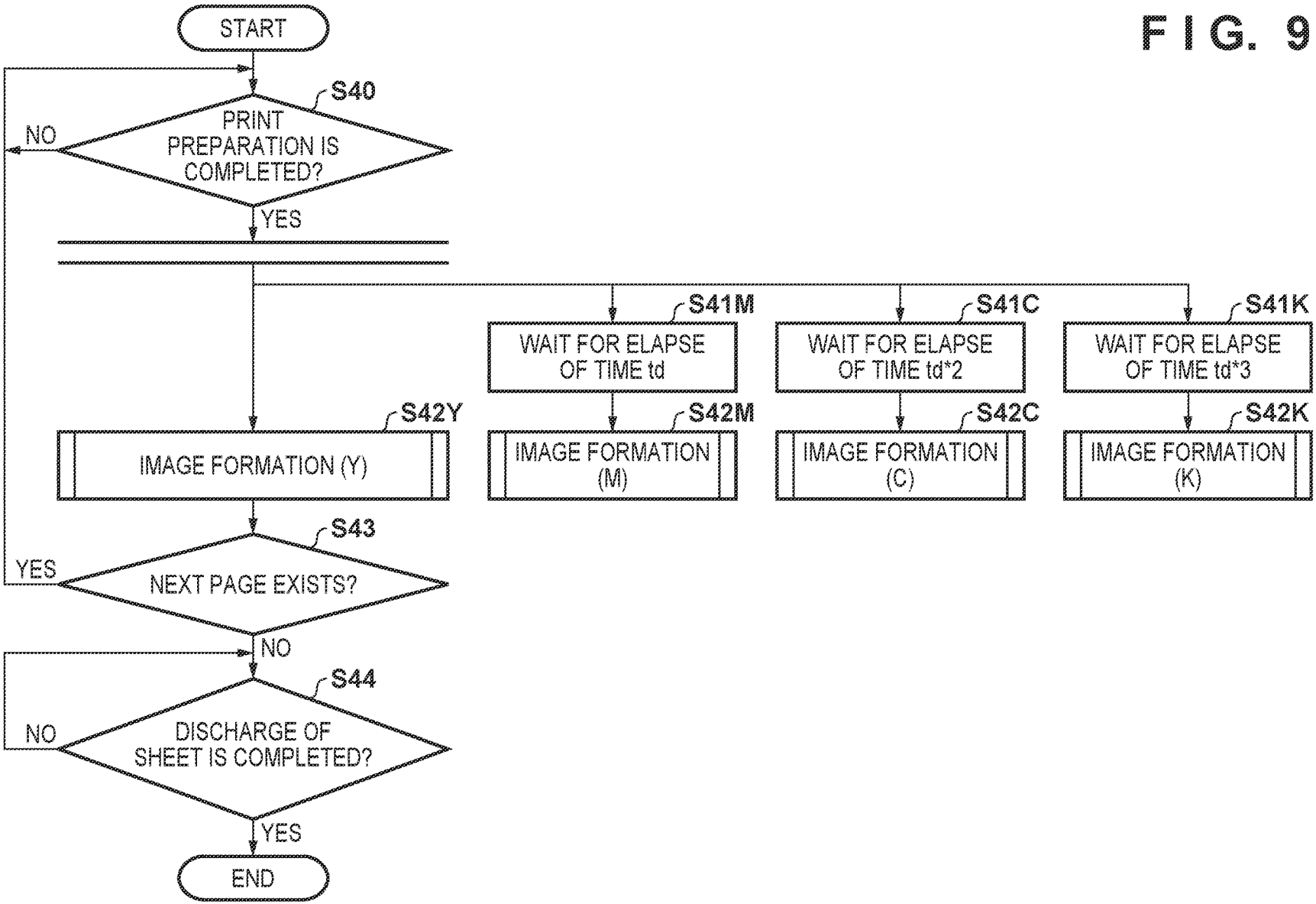
FIG. 9 is a flowchart of processing in an engine controller.

FIG. 9 shows a flowchart illustrating processing performed by the engine controller 250. The engine controller 250, upon being notified of the page information from the video controller 200, causes various types of actuators in the image forming apparatus 100 to operate to prepare for printing, in step S40. When the print preparation has been completed, image formation with respect to yellow, which is the color to be formed first, is performed in step S42Y. Meanwhile, with respect to magenta, cyan, and black, image formation is waited for a time period td, 2×td, 3×td in step S41M, step S41C, and step S41K, respectively, as described using FIG. 7. Then, after waiting, image formation is performed in step S42M, step S42C, and step S42K. When printing on one page is completed, the engine controller 250 determines whether or not page information with respect to the next page has been notified from the video controller 200, in step S43. If notification of the page information with respect to the next page has been made, the engine controller 250 repeats the processing from step S40 onward. Note that, because the actuators have already been driven in the first step S40, the processing in step S40 at repetition is completed in a shorter time period relative to the first time. Also, if notification of the page information with respect to the next page is not made, in step S43, the engine controller 250 ends the processing after the last printed sheet is discharged, in step S44.

Figure 10:
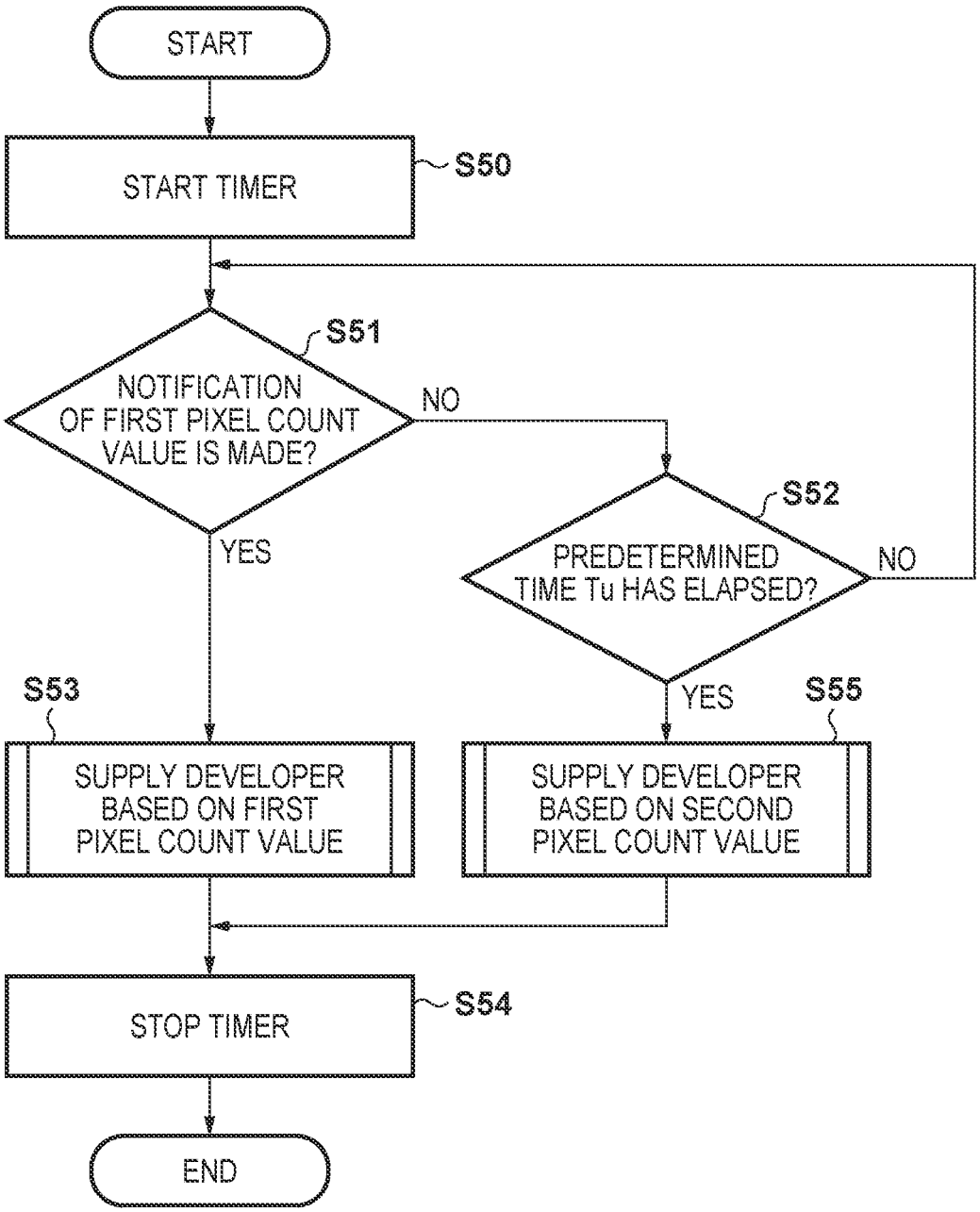
FIG. 10 is a flowchart of supply control of developer.

FIG. 10 is a flowchart of supply control of developer, in the engine controller 250, to be performed during image forming processing with respect to one page (step S42Y to step S43K, in FIG. 9). The engine controller 250, upon transmitting the image request signal 320, starts supply control of developer. That is, the transmission of the image request signal 320 indicates a start timing of the supply control. The CPU 251 of the engine controller 250, upon transmitting the image request signal 320, sets the timer value to 0, and thereafter starts measuring time using the timer (step S50). Next, the CPU 251 determines whether or not the first pixel count value has been notified from the video controller 200 (step S51). If notification of the first pixel count value has been made from the video controller 200, in step S51, the engine controller 250 executes the supply control based on the first pixel count value (step S53). Then, the CPU 251 stops the timer (step S54), and ends the processing of supply control of developer.

On the other hand, if notification of the first pixel count value has not been made, in step S51, the CPU 251 determines whether or not the time period measured by the timer has reached a predetermined time Tu (step S52). If the time period measured by the timer is less than the predetermined time Tu, in step S52, the CPU 251 advances the processing to step S51.

Also, if the time period measured by the timer has reached the predetermined time Tu, in step S52, the CPU 251 supplies the developer based on the second pixel count value (step S55). Then, the CPU 251 stops the timer (step S54), and ends the supply control of developer.

If the first pixel count value has not been input in a predetermined period from when the CPU 251 transmitted the image request signal 320 until the predetermined time Tu has elapsed, the CPU 251 performs the supply control based on the second pixel count value. That is, in the case where the predetermined time Tu has elapsed after the supply control started without notification of the first pixel count value, the CPU 251 performs the supply control using the second pixel count value instead of the first pixel count value. Note that the processing in FIG. 10 is performed for each developing unit.

Figure 11:
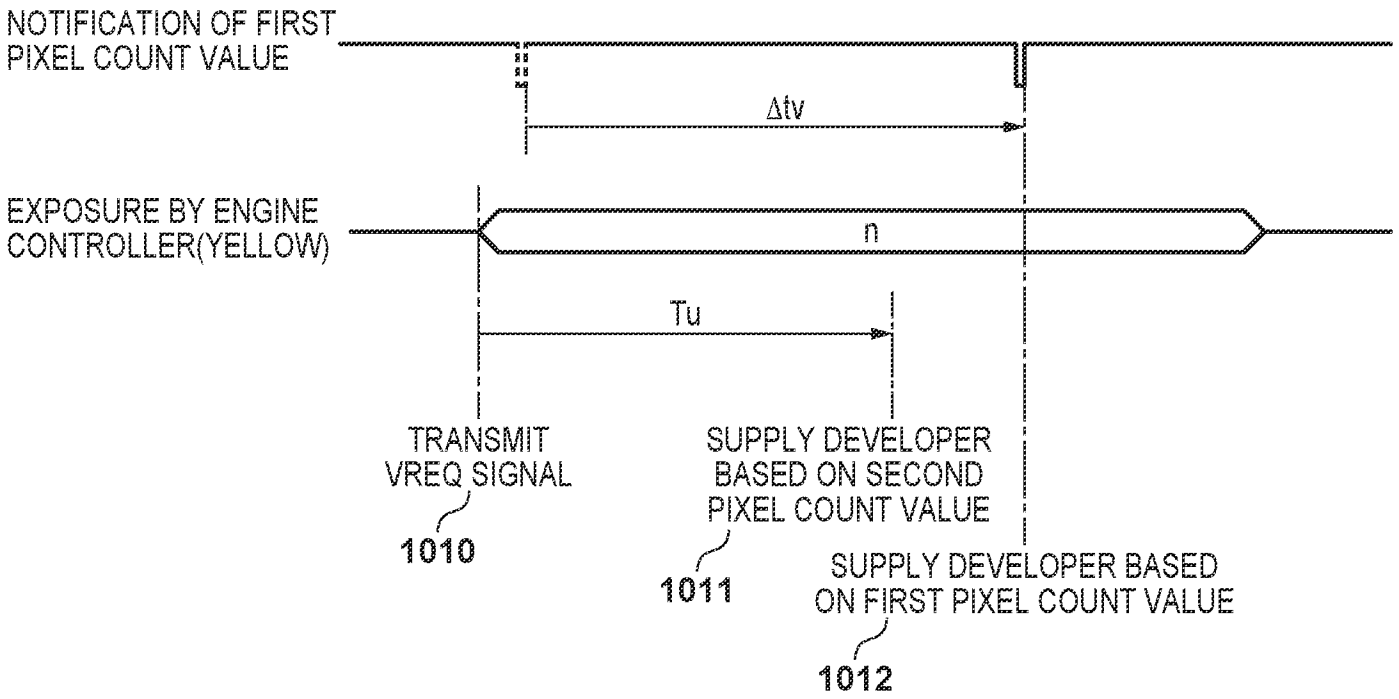
FIG. 11 is a timing chart of the supply control of developer.

FIG. 11 shows, with respect to yellow, the timing at which developer is to be supplied to the developing unit 105Y in the case of having received notification of the first pixel count value from the video controller 200 after the time period Tu has elapsed. Note that Δtv is a delay time of the notification of the first pixel count value from a reference timing due to the processing load of the video controller 200. Note that the reference timing is the timing at which notification of the first pixel count value is made when the processing load of the video controller 200 is lightest. The engine controller 250 transmits the image request signal 320 with respect to yellow to the video controller 200 at the timing indicated by the reference sign 1010. Also, the engine controller 250 starts the timer at the timing at which the image request signal 320 is transmitted. The engine controller 250 supplies the developer based on the second pixel count value at the timing indicated by the reference sign 1011 at which the time period Tu has elapsed. Thereafter, upon notification of the first pixel count value being made from the video controller 200 at the timing indicated by the reference sign 1012, the engine controller 250 supplies the developer based on the notified first pixel count value.

Figure 12:
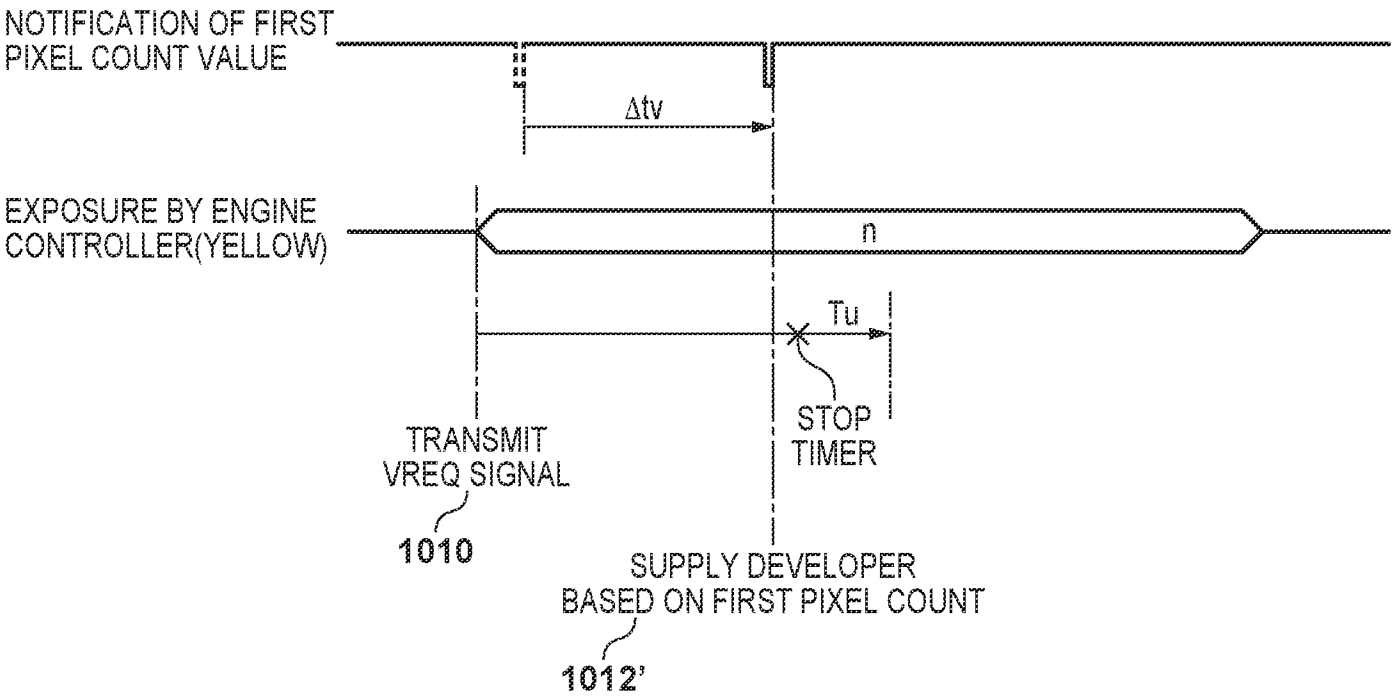
FIG. 12 is a timing chart of the supply control of developer.

FIG. 12 shows, with respect to yellow, the timing at which developer is to be supplied to the developing unit 105Y in the case of having received notification of the first pixel count value from the video controller 200 before the time period Tu has elapsed. As shown in FIG. 12, the engine controller 250 transmits the image request signal 320 with respect to yellow to the video controller 200 at the timing indicated by the reference sign 1010. Also, the engine controller 250 starts the timer at the timing at which the image request signal 320 is transmitted. The engine controller 250 receives the first pixel count value from the video controller 200 at the timing indicated by the reference sign 1012' before the time period Tu has elapsed. The engine controller 250, upon receiving the first pixel count value, stops the timer, and supplies the developer based on the notified first pixel count value. Therefore, the supply of developer based on the second pixel count value is not performed.

Figure 13:
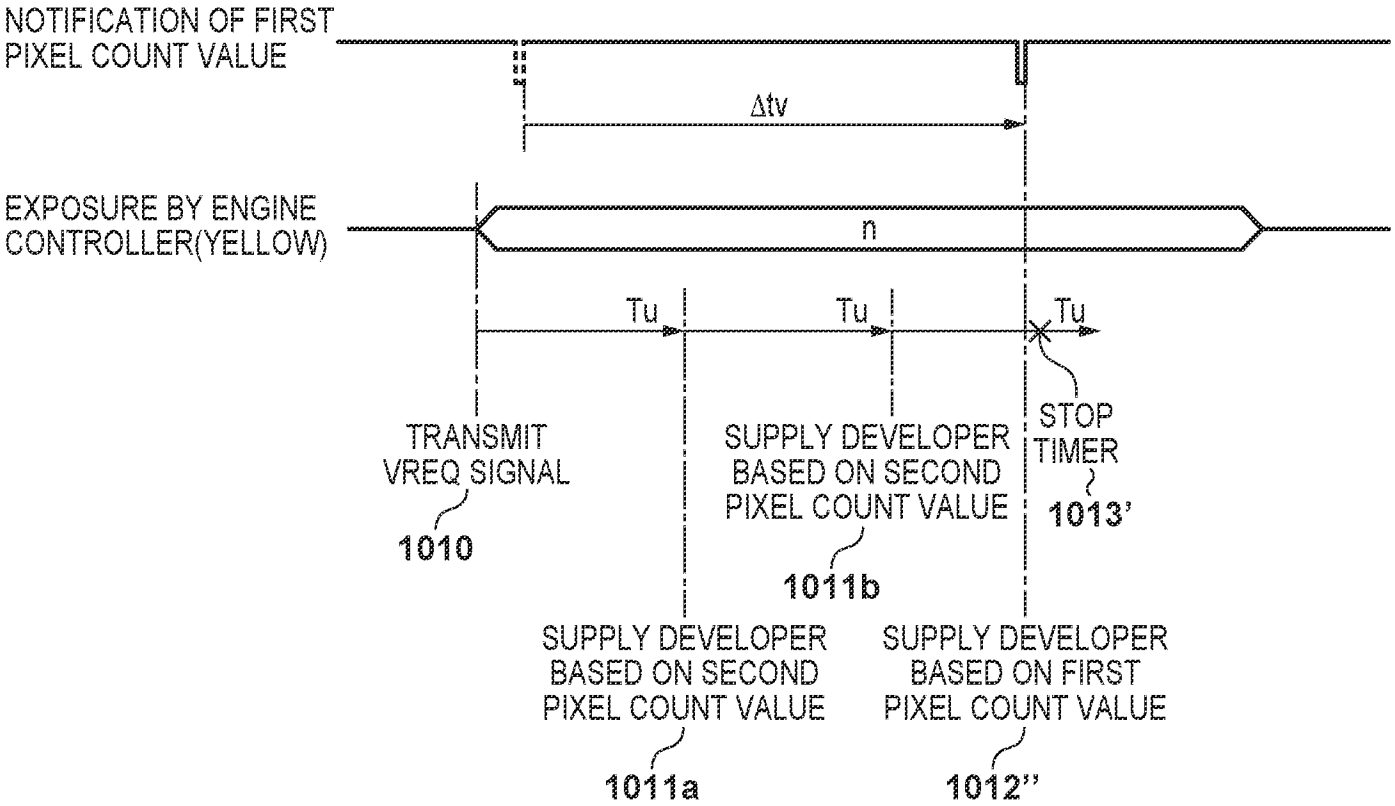
FIG. 13 is a timing chart of the supply control of developer.

Note that, as shown in FIG. 13, a configuration may be adopted in which supply of developer based on the second pixel count value is executed a plurality of times in a period in which image forming processing is performed on one sheet. In FIG. 13, supply of developer based on the second pixel count value is performed upon the time period Tu elapsing at the timing indicated by the reference sign 1101*a*. Also, the timer is reset at the timing indicated by the reference sign 1101*a*. Thereafter, supply of developer based on the second pixel count value is again performed upon the time period Tu elapsing at the timing indicated by the reference sign 1101*b*. Thereafter, notification of the first pixel count value is made from the video controller 200 at the timing indicated by the reference sign 1012", and accordingly, the developer is supplied based on the first pixel count value. Note that, as a result of setting the time period Tu shorter as the capacity of the developing unit 105 decreases or the throughput of the image forming apparatus 100 increases, fluctuation in volume of the toner inside the developing unit 105 can be easily suppressed.

Figure 14:
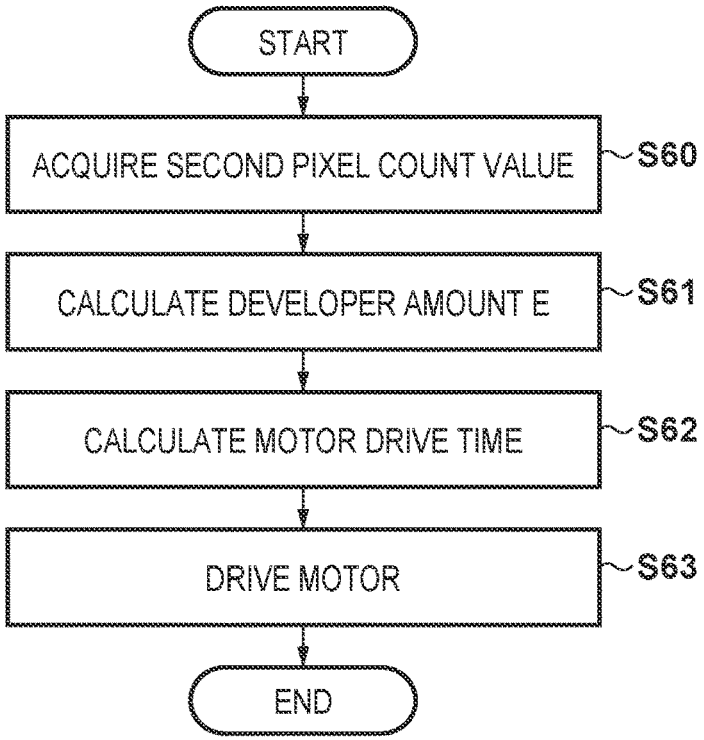
FIG. 14 is a flowchart of the supply control of developer based on the first pixel count value.
Figure 16A:
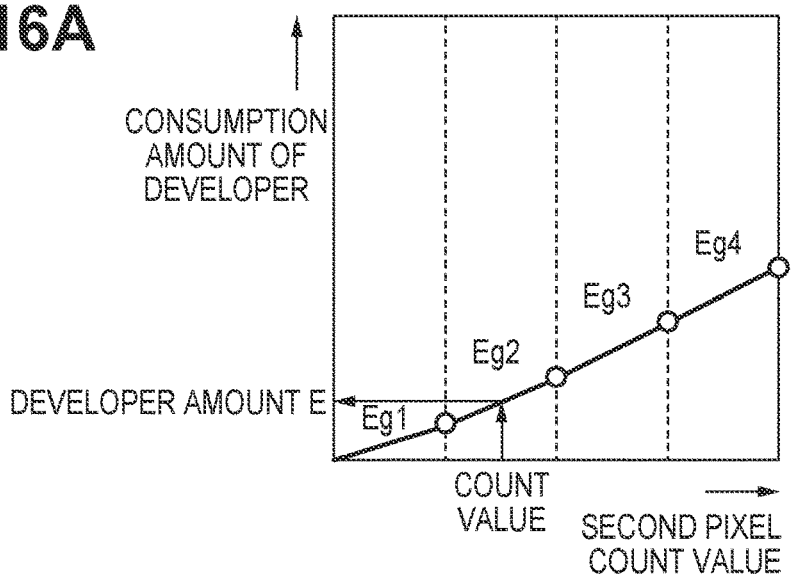
FIGS. 16A to 16C are diagrams for describing calculation of a consumption amount of developer based on a pixel count value.

FIG. 14 is a flowchart of the supply control of developer based on the second pixel count value. The engine controller 250 reads out the second pixel count value from a register (unshown) in the pixel count unit 351, in step S60. The engine controller 250 determines a developer amount E based on the second pixel count value, in step S61. The developer amount E is determined using a relationship between a value (count value) of the second pixel count value and a consumption amount of developer, as shown in FIG. 16A, for example. For example, the amounts of consumption (Eg1 to Eg4) of developer corresponding to a plurality of count values are measured in advance, and the measured values are stored in the ROM 252 of the engine controller 250 as pieces of data. Also, the engine controller 250 obtains the developer amount E by performing linear interpolation with respect to two points that are selected so as to include the second pixel count value that has been read out. After calculating the developer amount E, the engine controller 250 calculates the drive time of the motor 2131, in step S62. Specifically, the developer amount to be supplied per unit drive time of the motor 2131 is obtained, in advance, through experiments or the like. The engine controller 250 calculates the drive time by dividing the developer amount E by the developer amount to be supplied per unit drive time. The engine controller 250 drives the motor 2131 for the obtained period of drive time, in step S63.

Figure 16B:
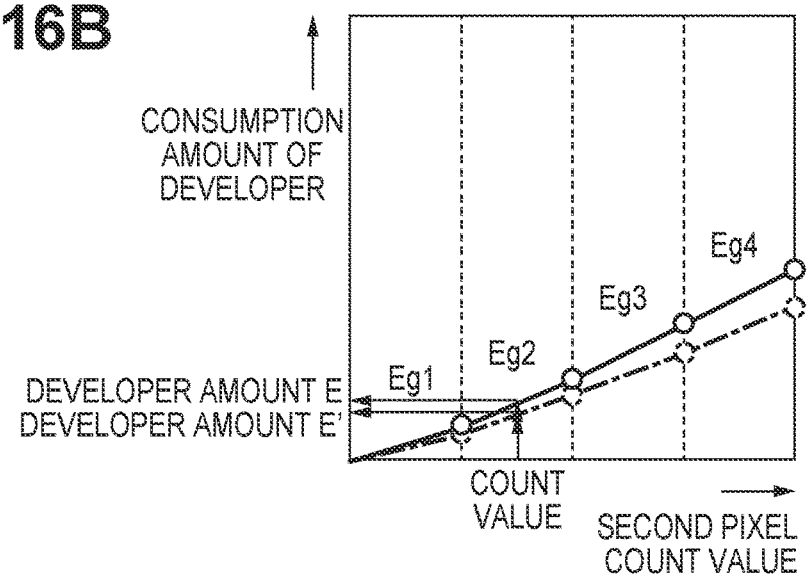

Note that, as described above, the correlation between the second pixel count value and the actual consumption amount of developer is relatively low. For example, if toner is supplied to the developing unit 105 in an amount larger than the adequate amount, unnecessary processing and unnecessary consumption of the developer may be incurred such as a developer image being formed separately from an image to be printed on a sheet and collecting the toner using the cleaning unit in order to reduce the toner in the developing unit 105. Therefore, when calculating the consumption amount of developer, a coefficient that is larger than 0 and smaller than 1 can be applied as well to the characteristic obtained through the experiments, as shown in FIG. 16B. For example, the engine controller 250 can obtain a developer amount E by multiplying the developer amount E obtained from the characteristic shown by the solid line in FIG. 16A by a coefficient that is larger than 0 and smaller than 1. Also, a characteristic obtained by correcting the characteristic shown by the solid line in FIG. 16A using a coefficient can also be used, as shown by the one dot chain line in FIG. 16B. In this case, the engine controller 250 obtains the developer amount E from the characteristic shown by the one dot chain line, and supplies the developer of the developer amount E to the developing unit 105. Accordingly, the amount of developer in the developing unit 105 can be suppressed from becoming excessive.

Figure 15:
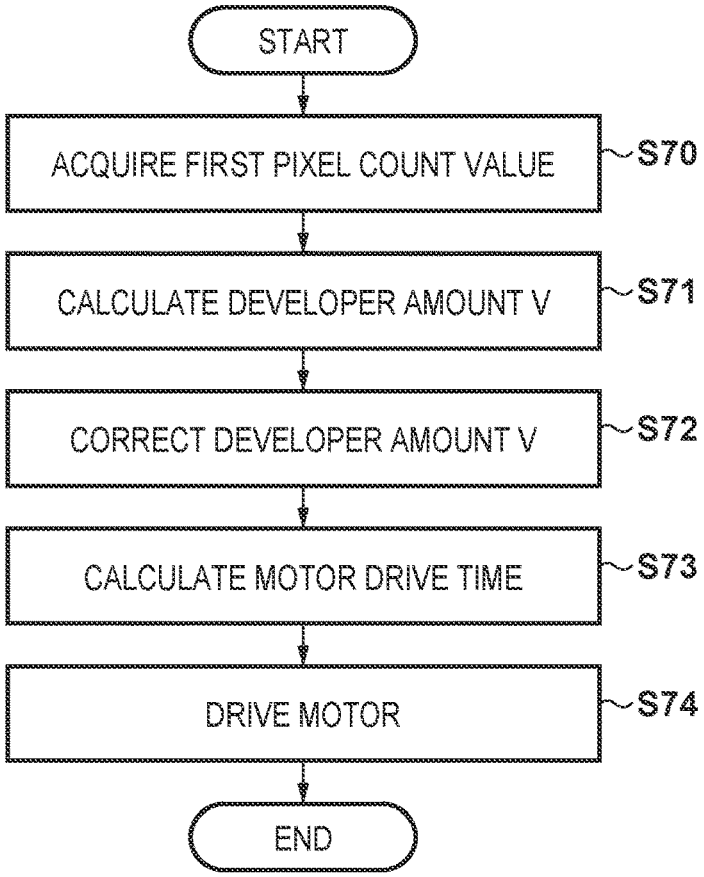
FIG. 15 is a flowchart of the supply control of developer based on a second pixel count value.
Figure 16C:
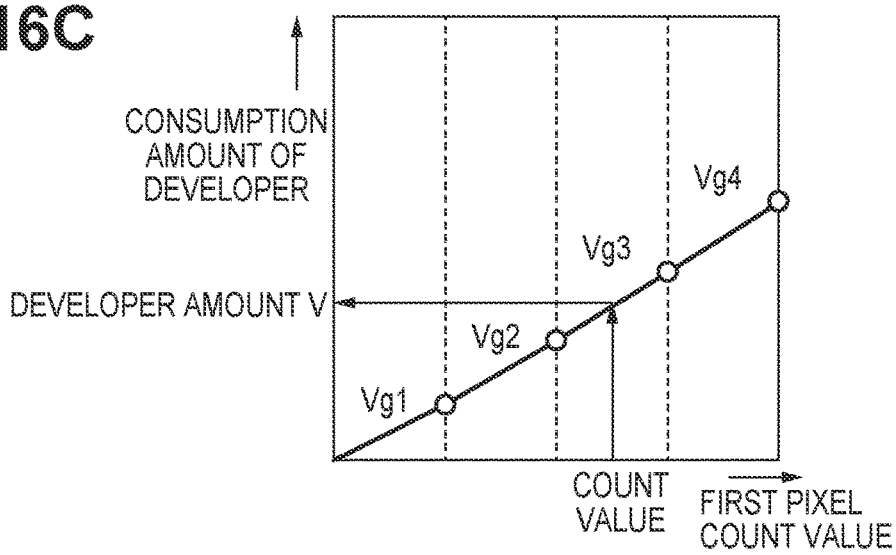
Figure 17A:
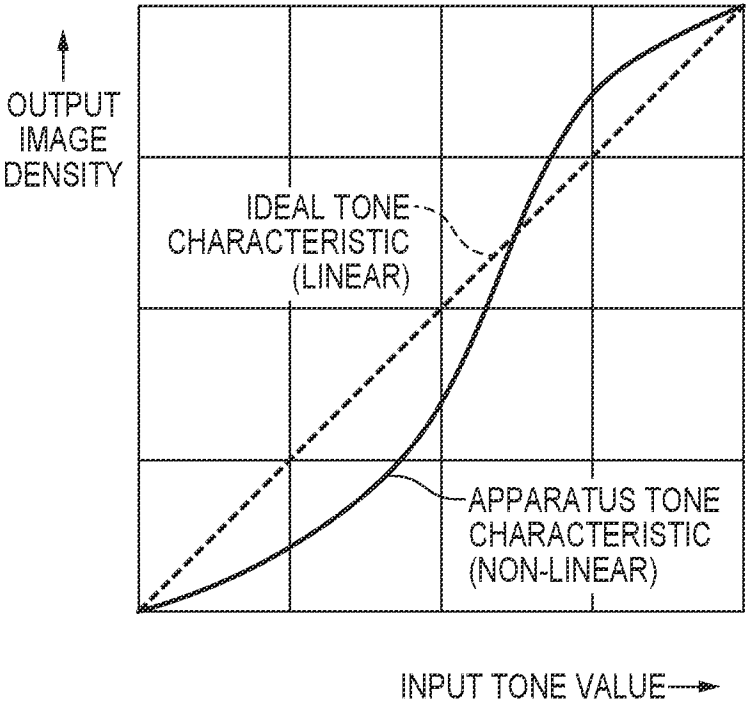
FIGS. 17A and 17B are diagrams for describing tone correction.
Figure 17B:
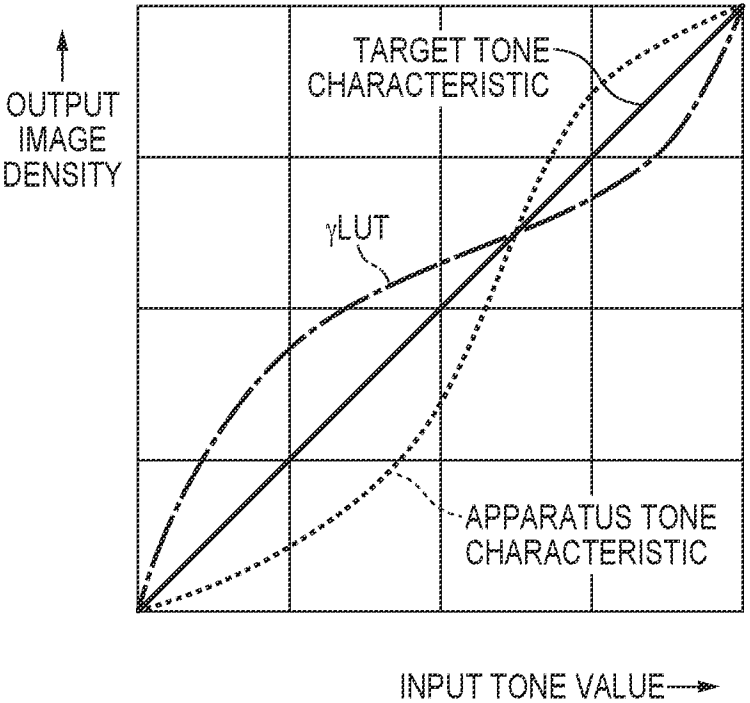

FIG. 15 is a flowchart of supply processing of developer based on the first pixel count value notified from the video controller 200. The engine controller 250, upon acquiring the first pixel count value from the video controller 200, in step S70, obtains a developer amount V based on the first pixel count value, in step S71. The developer amount V is obtained using a relationship between the first pixel count value and a consumption amount of developer, as shown in FIG. 16C, for example. For example, amounts of consumption of developer (Vg1 to Vg4) corresponding to a plurality of count values are measured in advance and stored in the ROM 252 of the engine controller 250 as data. Also, the engine controller 250 obtains the developer amount V by performing linear interpolation between two points selected so as to include the first pixel count value.

Next, if the developer amount V is larger than the developer amount E, in step S72, the engine controller 250 subtracts the developer amount E from the developer amount V so as to calculate a developer amount Vc, which is a corrected value of the developer amount V. Note that, in the case where the developer is not supplied based on the second pixel count value, the developer amount E is 0, and the corrected developer amount Vc has the same value as the developer amount V. Thereafter, the engine controller 250 performs, in steps S73 and S74, processing similar to those in steps S62 and S63, in FIG. 14. Note that, in the case where the developer amount based on the first pixel count value is less than or equal to the developer amount based on the second pixel count value, that is, in the case where the developer amount V is less than or equal to the developer amount E, steps S73 and S74 are skipped. That is, supply of the developer in steps S73 and S74 is not performed.

As described above, in the present embodiment, both the first pixel count value based on image data before tone processing and the second pixel count value based on the image data subjected to the tone processing are counted. Therefore, even in a case where acquisition of the first pixel count value is delayed, the engine controller 250 can supply the developer based on the second pixel count value, and therefore an excess or shortage of the developer can be suppressed.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-172426, filed on Sep. 7, 2017, which is hereby incorporated by reference herein in its entirety.

What is claimed is:

1. An image forming apparatus comprising:

a first controller having an image processor that performs image processing on image data, the first controller configured to determine a first statistic value based on the image data, and output the first statistic value;

an obtaining unit configured to obtain the image data from the image processor;

an image forming unit configured to form, based on the image data obtained by the obtaining unit, an image by using toner;

a supply unit configured to supply toner to the image forming unit; and a second controller configured to control the supply unit based on the first statistic value output from the first controller, wherein, in a case where the first statistic value is not outputted by the first controller in a predetermined period, the second controller controls the supply unit based on a second statistic value, the second statistic value being determined based on the image data obtained by the obtaining unit.

2. The image forming apparatus according to claim 1, wherein the first controller has a memory configured to store the first statistic value, and the first controller outputs the first statistic value to the second controller after a predetermined condition is satisfied.

3. The image forming apparatus according to claim 1, wherein the first controller outputs the first statistic value to the second controller after the first statistic value with respect to one page of a sheet is determined.

4. The image forming apparatus according to claim 1, wherein the predetermined period corresponds to a period from when the second controller transmitted a signal for requesting reception of the first statistic value to the first controller to until a predetermined time has elapsed.

5. The image forming apparatus according to claim 1, wherein the second controller controls the supply unit based on a consumption amount of toner stored in the image forming unit, the second controller determines the consumption amount based on the first statistic value, in a case where the first statistic value is outputted by the first controller in the predetermined period, and the second controller determines the consumption amount based on the second statistic value, in a case where the first statistic value is not outputted by the first controller in the predetermined period.

6. The image forming apparatus according to claim 1, wherein the supply unit includes a motor that is driven to supply toner to the image forming unit, and the second controller controls a drive time of the motor.

7. The image forming apparatus according to claim 1, wherein the supply unit includes a motor that is driven to supply toner to the image forming unit, the second controller controls a drive time of the motor based on the first statistic value, in a case where the first statistic value is outputted by the first controller in the predetermined period, and the second controller controls the drive time of the motor based on the second statistic value, in a case where the first statistic value is not outputted by the first controller in the predetermined period.

* * * * *